US006050334A

United States Patent [19]

McGarian et al.

[11] Patent Number: 6,050,334

[45] Date of Patent: Apr. 18, 2000

[54] SINGLE TRIP WHIPSTOCK ASSEMBLY

[76] Inventors: Bruce McGarian, 23 East Gleve, Stonehaven, Aberdeen, AB3 2HW; Manfred Steinkamp, Westwinds, Cammachmore, Kincardine, Aberdeen, AB3 2NY, both of United Kingdom

[21] Appl. No.: 08/983,220

[22] PCT Filed: Jul. 8, 1996

[86] PCT No.: PCT/GB96/01627

§ 371 Date: Jan. 7, 1998

§ 102(e) Date: Jan. 7, 1998

[87] PCT Pub. No.: WO97/03274

PCT Pub. Date: Jan. 30, 1997

[30] Foreign Application Priority Data

Jul. 7, 1995 [GB] United Kingdom ..... 9513922
Aug. 9, 1995 [GB] United Kingdom ..... 9516352

[51] Int. Cl.[7] ..... E21B 7/08

[52] U.S. Cl. ..... 166/117.6; 175/80; 175/82

[58] Field of Search ..... 175/80, 81, 82; 166/117.6, 298, 50

[56] References Cited

U.S. PATENT DOCUMENTS

| | | | |
|---|---|---|---|
| 2,216,963 | 10/1940 | Sinclair | 166/55.3 |
| 2,940,522 | 6/1960 | Taylor et al. | 166/55 |
| 4,397,355 | 8/1983 | McLamore | 166/297 |
| 4,429,741 | 2/1984 | Hyland | 166/117.6 |
| 5,035,292 | 7/1991 | Bailey et al. | 175/45 |
| 5,109,924 | 5/1992 | Jürgens et al. | 166/117.5 |
| 5,199,513 | 4/1993 | Stewart et al. | 175/73 |
| 5,322,135 | 6/1994 | Travis | 175/58 |
| 5,379,845 | 1/1995 | Blount et al. | 166/382 |
| 5,383,522 | 1/1995 | Hailey | 166/382 |
| 5,425,419 | 6/1995 | Sieber | 166/206 |
| 5,443,129 | 8/1995 | Bailey et al. | 175/45 |
| 5,551,509 | 9/1996 | Braddick | 166/55.7 |
| 5,592,991 | 1/1997 | Lembcke et al. | 166/298 |
| 5,595,247 | 1/1997 | Braddick | 166/297 |
| 5,771,972 | 6/1998 | Dewey et al. | 166/298 |
| 5,816,324 | 10/1998 | Swearingen et al. | 166/117.5 |

*Primary Examiner*—Hoang Dang
*Attorney, Agent, or Firm*—Watson Cole Grindle Watson, P.L.L.C.

[57] ABSTRACT

A single trip whipstock assembly which can be run into a well, set, and operated from a window in the well casing in a single trip includes a milling tool (5) attached to the upper end of a whipstock (6) to the lower end of which is attached a packer (7) or anchor which can be set by appropriate means prior to detachment of the mill from the whipstock to initiate window formation. The packer may be hydraulic and may be set by means of a setting tool (4) located above the mill (5) and connected to the packer by a hose (21). The mill (5) incorporates circulation ports which are initially isolated from the central chamber thereof to permit flow of hydraulic fluid from the setting tool to the hose (21) via the interior of the mill. Once setting has been effected, the hose (21) is severed, permitting the piston of the setting tool to operate a flow diverter within the mill and open the circulation ports to the interior of the tool for subsequent drilling mud circulation during milling operation. The whipstock (6) includes a relatively steep ramp (32) at the upper end thereof so that initial breakthrough of the casing is effected predominantly using the side blades of the mill (5).

15 Claims, 5 Drawing Sheets

SINGLE TRIP WHIPSTOCK ASSEMBLY

This application is a 371 of PCT/GB96/01627 filed Jul. 8, 1996.

BACKGROUND OF THE INVENTION

1. Field of the Invention

This invention relates to a single trip whipstock assembly, that is to say a whipstock assembly which can be run complete into a wellbore, set, and operated to mill a window in the casing of the wellbore and open up a lateral in the surrounding formation in a single trip.

2. The Prior Art

In the drilling of oil and gas wells it is sometimes necessary to form a branch extending off an existing bore. Such branches (generally known as "laterals") are in general formed by locating a tapering deflector device (known as a "whipstock") in the existing bore, and then using the whipstock to deflect a milling tool laterally of the axis of the existing bore to mill a window in the surrounding casing. Once the window has been milled, drilling of the surrounding formation can continue using the milling tool or the milling tool can be withdrawn from the well and replaced by an appropriate formation drilling assembly.

Heretofore, the initiation of a lateral using a whipstock system has necessitated a number of separate trips into the well. Typically, a packer is first run into the well and, using appropriate equipment, is located at the correct depth and orientation and is set. The packer string is then removed from the well, leaving the packer in position, and the whipstock, possibly in association with one or more mills, is run into the well to mate with the packer prior to commencement of the milling operation.

Various attempts have been made to increase the efficiency of the formation of a lateral using a whipstock system, and in particular U.S. Pat. No. 5,109,924 illustrates a window milling assembly to make the cut out and mill the window in one run, and U.S. Pat. No. 5,425,419 illustrates a system in which a deflector head at the top of the whipstock is used to locate the milling tool. All prior art systems, however, require some form of anchor or packer to locate the whipstock at the correct depth and orientation. Such anchors or packers must be run into the well on a separate trip from the whipstock proper necessitating at least two trips in any whipstock milling operation.

SUMMARY OF THE INVENTION

The present invention aims to improve the known techniques for forming a lateral using a whipstock system by providing a whipstock assembly which incorporates a packer or anchor and which can be run into a well, set, and operated in a single trip.

According to one aspect of the present invention a single trip whipstock assembly includes a whipstock having a milling tool attached to the upper end thereof and a packer or anchor attached to the lower end thereof, the packer or anchor being settable to fix the depth of the whipstock prior to, but during the same trip as, operation of the milling tool to form a window in the casing of the wellbore.

In general, the lateral will have a required heading and accordingly the connection between the whipstock and the packer or anchor will prevent relative rotation therebetween so that, after the assembly has been run into the wellbore to the required depth, the assembly can be orientated by appropriate means (for example using signals derived from a measuring while drilling tool which may optionally form part of the assembly) prior to setting of the packer or anchor. Once the packer or anchor has been set, the orientation of the face of the whipstock relative to ground co-ordinates, which will determine the heading of the lateral, will be fixed by virtue of the non-rotatable connection between the whipstock and the packer or anchor.

In a particularly preferred embodiment of the invention the milling tool is secured directly to the top end of the whipstock by releasable fastening means, for example shear bolts. Accordingly, after the packer or anchor has been set and the setting verified by appropriate loading of the drillstring, an upward or downward load can be applied to the drillstring sufficient to release the releasable fastenings, whereafter milling can commence.

Preferably, the upper end of the whipstock is formed with a ramp surface which extends at a larger angle to the axis of the wellbore than the angle of the major deflecting face of the whipstock to the axis. For example, the ramp surface may extend at an angle of 5° to the axis of the wellbore whilst the main deflecting face of the whipstock may extend at an angle of 2.8° relative to the axis of the whipstock. The ramp surface is positioned to be engaged by the milling tool as the milling tool is lowered after release of the releasable fastenings and will cam the milling tool radially of the borehole into engagement with the well casing. In order to prevent excessive wear of the ramp surface, the ramp surface is preferably hardened, hard faced, or provided with wear resistant inserts. As the milling tool is lowered, the relatively steep angle of the ramp will force the milling tool lateral into engagement with the casing, thereby enabling rapid penetration of the casing.

Preferably, the milling tool includes a main mill having end blades on the end face thereof and side blades on the radial periphery thereof. During the initial phase of casing penetration when the milling tool is running up the ramp surface, both the end blades and side blades mill the casing. The transition between the ramp surface and the main deflecting surface is located such that the casing will be broken through by the combined action of the end and side blades at the moment when the leading edge of the milling tool passes from the ramp surface onto the main deflecting surface of the whipstock. Thereafter, continued downward movement of the whipstock will result in progressive opening of the window using mainly the end blades of the main mill. These blades will be relatively undulled by the initial breaking through of the casing since much of the milling during the initial breaking through will be accomplished by the side blades. Also, the contact between the main mill and the ramp surface will be via the side blades and accordingly the end blades will be undulled by such contact. At the commencement of the main phase of end milling, the end blades will accordingly be in substantially as new condition and well suited to the subsequent opening up of the window which is accomplished mainly using the end blades.

Preferably, the assembly includes one or more additional mills located uphole relative to the main mill. Such additional mills may, for example, include one or more watermelon mills.

In a particularly preferred embodiment of the invention the packer or anchor is a hydraulic packer and the means for setting the packer includes a hydraulic pressure generator located uphole of the whipstock and a severable connection between the hydraulic pressure generator and the hydraulic packer. The severable connection can conveniently take the form of a severable pipe which initially extends through a bore in the lower part of the whipstock and along the face of the upper part of the whipstock. Once the hydraulic packer has been set the severable connection is severed to allow milling to start. Any components of the severable connection which remain in a position which will interfere with the milling operation will be destroyed during the milling operation.

In a particularly preferred embodiment of the invention the hydraulic force generator includes a setting tool having a cylinder filled with hydraulic fluid and in communication with the severable connection, and a piston which can be acted upon by mud pressure supplied through the drillstring upon which the whipstock assembly is mounted in order to pressurize the hydraulic fluid. Preferably, a flow sensitive by-pass valve is mounted in the drillstring above the setting tool so that mud can be circulated through the drillstring as the assembly is lowered into the well. Thereafter the mud flow rate can be increased to close the by-pass valve and allow static pressure to be applied to the piston of the setting tool.

Preferably, the hydraulic pressure generator is connected to the severable connection via a chamber located in the interior of the milling tool In a particularly preferred embodiment of the invention the main mill includes circulation ports which, during milling, enable mud from the chamber of the milling tool to be circulated to the exterior of the milling tool. Accordingly, the milling tool is provided with a diverter which initially isolates the circulating ports from the chamber so as to allow hydraulic pressure generated by the hydraulic pressure generator to be communicated to the severable connection. Preferably, the piston of the hydraulic pressure generator is movable to a by-pass position which allows mud to flow past the piston and into the chamber of the milling tool after setting of the hydraulic packer has been completed. Preferably, movement of the piston of the hydraulic pressure generator into its by-pass position simultaneously opens the circulation ports of the milling tool to the chamber thereof.

In a particularly preferred embodiment of the invention the diverter which initially isolates the circulation ports of the main mill from the chamber thereof is held in its initial position by a releasable fixing device, for example a shear ring or shear pins, and is released from its initial position by action of the piston of the hydraulic pressure generator. Preferably, the piston of the hydraulic pressure generator, in moving from its pressure generating position to its by-pass position, automatically moves the flow diverter from its initial position to its open position to allow circulation of drilling mud through the circulation ports.

The invention will be better understood from the following description of a preferred embodiment thereof, given by way of example only, reference being had to the accompanying drawings.

DETAILED DESCRIPTION OF THE PREFERRED EMBODIMENTS

Figure 1:
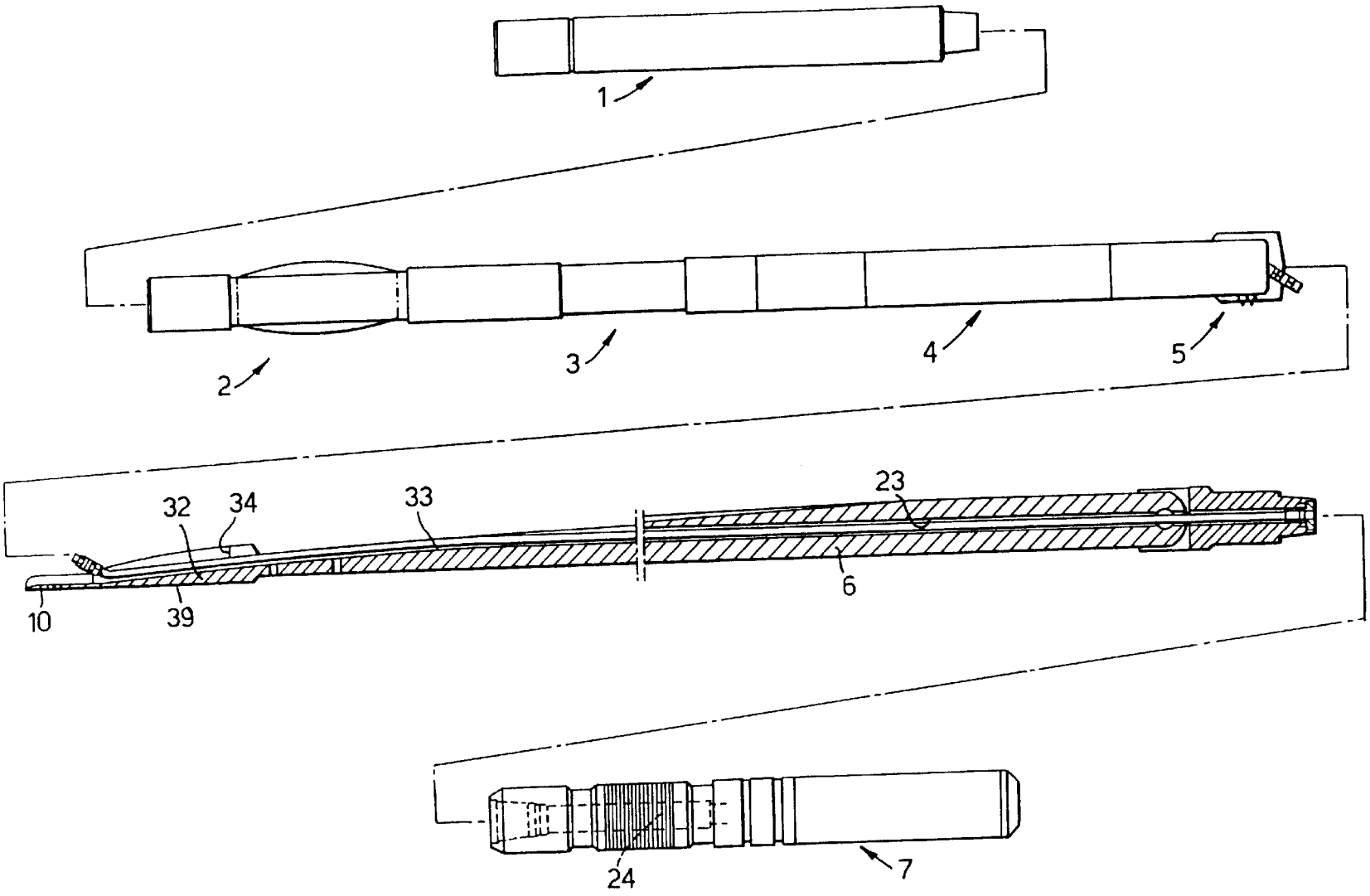
FIG. 1 illustrates a first embodiment of the invention.

Referring firstly to FIG. 1, the illustrated single trip whipstock assembly includes a multi-cycle by-pass valve 1; a watermelon mill 2; a flex joint 3; a setting tool 4; a main mill 5; a whipstock 6; and a hydraulic packer 7. The by-pass valve 1, watermelon mill 2, flex joint 3, setting tool 4, and main mill 5 are interconnected by conventional pin connections, and the whipstock 6 is connected to the hydraulic packer 7 by a conventional pin connection. The main mill 5 is connected to the whipstock by a suitable releasable fastening means described in more detail hereinafter. In use, the complete assembly is run into a well on suitable tubing to the required depth, is correctly orientated, for example using information from a measuring while drilling tool located above the by-pass valve, and then the packer is set. The connection between the main mill 5 and whipstock 6 is then released to allow milling of a window in the surrounding casing, and the commencement of the drilling of a lateral, using the main mill 5. The window formed by the main mill 5 is opened up and cleaned by the watermelon mill 2.

Figure 3:
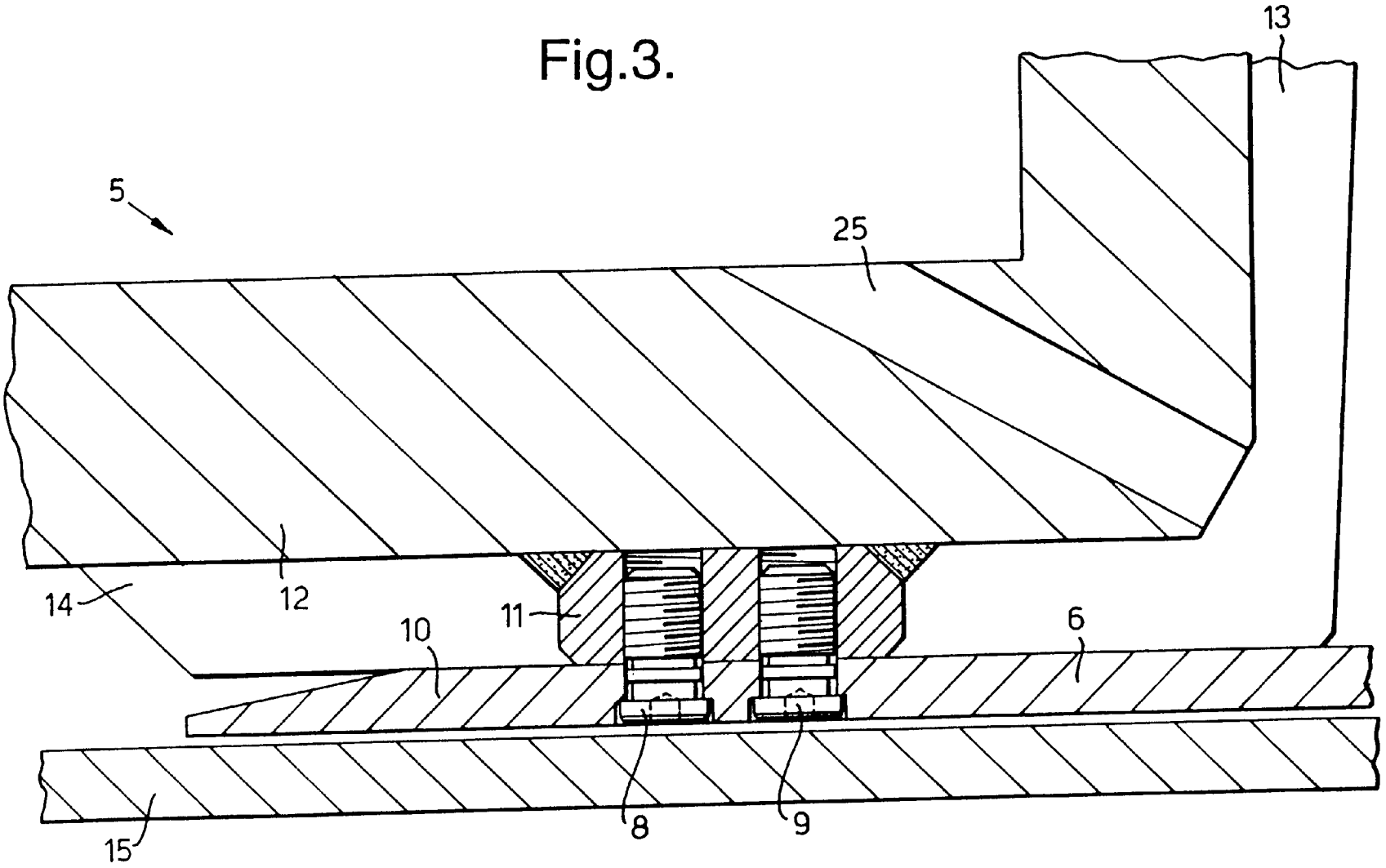
FIG. 3 illustrates the means of connecting the main mill of FIG. 1 or FIG. 2 to the whipstock thereof.

As assembled, the main mill 5 is connected to the extreme upper end of the whipstock 6 by means of releasable fasteners, for example shear bolts 8,9 as illustrated in FIG. 3. For this purpose, the upper end of the whipstock 6 is formed with a tang 10 having counterboard apertures therein for receiving the shear bolts 8,9. The shear bolts engage threaded bores provided in a block 11 which is welded to or integral with the body 12 of the main mill. The main mill is formed with a multiplicity of end blades 13 which extend across the end face thereof and a multiplicity of side blades 14 which extend along the side of the body 12 away from the end blades 13. The block 11 is located between adjacent side blades 14. The strength of the shear bolts 8,9 is selected so that the entire assembly can safely be run into the well and the packer 7 set and tested without shearing the bolts 8,9. Thereafter, an appropriate up or down load is applied to the assembly to shear the bolts 8,9 and thereby release the main mill 5, setting tool 4, flex joint 3, watermelon mill 2 and valve 1 from the whipstock. Milling of the casing can then commence as described below.

It will be noted that the internal diameter of the casing 15 is spanned by the combination of the main mill 5 and the tang 10. It follows from this that the diameter of the main mill 5 will be less than the internal diameter of the casing 15. For example, in casing 15 having an internal diameter of 8.686 inches the effective diameter of the whipstock and main mill combination could be in the order of 8.0 inches with the result that the mill diameter will be in the order of 7.76 inches. As a result, the clearance diameter of the window to be milled by the main mill 5 would be less than the internal diameter of the casing 15. However, the watermelon mill 2 may have an effective diameter equal to the internal diameter of the casing 15 (less any necessary clearance) and accordingly the window milled by the main mill 5 will be opened up to full diameter by the watermelon mill.

Referring back to FIG. 1, the by-pass valve 1, watermelon mill 2 and flex joint may be standard items known to those skilled in the wellboring industry and their nature, construction and operation will be well known to those skilled in the art. The setting tool 4 and main mill 5 are shown in greater detail in FIG. 4.

Figure 4:
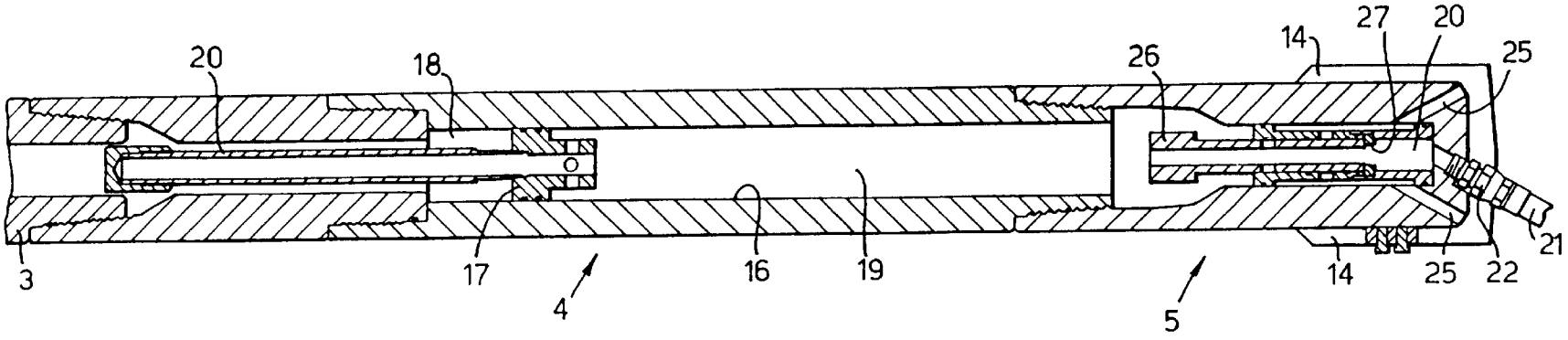
FIG. 4 illustrates is a cross-sectional view, on a larger scale, of the setting tool and main mill of the embodiment of FIG. 1 with the internal components thereof in their initial position.

Referring to FIG. 4, the setting tool 4 is a hydraulic pressure generating device including a cylinder 16 and a piston 17 slidingly and sealingly mounted in the cylinder 16. The piston 17 is shown in or close to its initial position. The cylinder 16, above the piston 17, forms a mud chamber 18 which is connected via the central bores of the flex joint 3 and watermelon mill 2 to the by-pass valve 1. The cylinder 16 below the piston 17 forms a hydraulic chamber 19 which is initially filled with hydraulic fluid. For the purpose of filling the cylinder 19 the piston 17 is preferably provided with a filling tube 20 having a removable end cap 21.

The chamber 19 is connected to the hydraulic packer by way of a chamber 20 formed in the main mill and a flexible hose 21 which runs from a nipple 22 secured to the main mill along the face of the upper part of the whipstock 6 and thereafter through an axial bore 23 provided in the whipstock. At the lower end of the whipstock the tube 21 opens into the actuation chamber 24 of the hydraulic packer 7. The hydraulic packer 7 can be of any suitable design. The chamber 20 is, during milling operation, used to communicate drilling fluid from the string to circulation ports 25 provided in the main mill. In order to prevent loss of hydraulic fluid through the circulation ports 25 prior to commencement of the milling operation a flow diverter 26 is located within the chamber 20 and, in the initial position illustrated, isolates the chamber 20 from the circulation ports 25. The flow diverter 26 is held in its initial position by a shear ring 27.

In use, the entire assembly illustrated in FIG. 1, together with any necessary orientation equipment, is run into the well to the required depth, is rotated to bring the face of the whipstock to the required heading, and the hydraulic packer is then set. In order to set the packer, flow rate through the string is increased to close the by-pass valve and to enable a static head to be generated within the string. The static head is applied to the piston 17 to pressurize the hydraulic fluid in the hydraulic chamber 19. Pressurized hydraulic fluid flows from the chamber 19 via the chamber 20, nipple 22, and hose 21 to the operating chamber 24 of the hydraulic packer.

Figure 5:
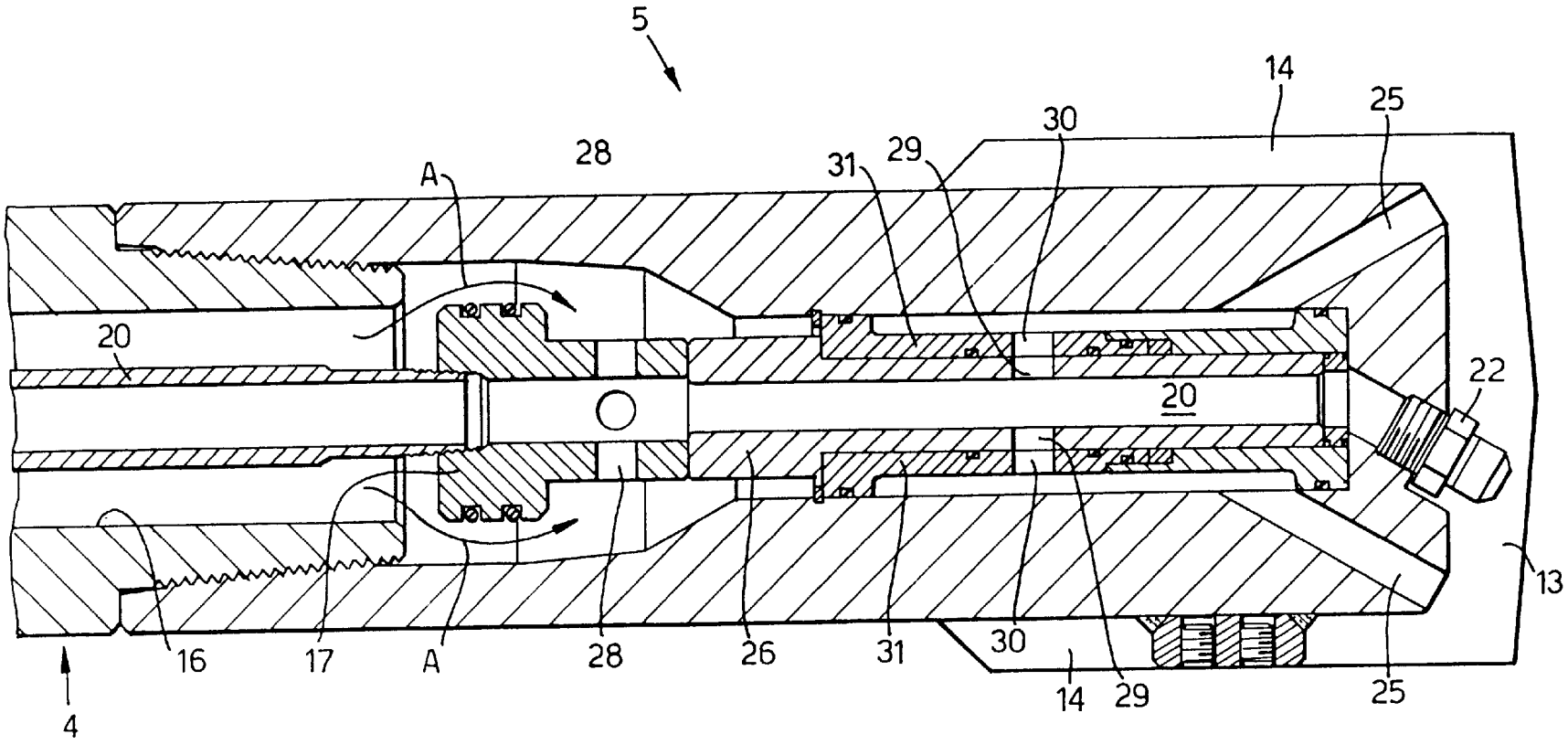
FIG. 5 is a view on a larger scale of the main mill and the bottom of the setting tool showing the internal components thereof in their final position.

After an appropriate drillstring pressure has been maintained for a length of time suitable to set the packer 7, setting of the packer can be tested by applying an appropriate upward and downward loading onto the string. If this test verifies that the packer is set, a larger upward or downward loading is applied to the string in order to shear the bolts 8,9 which connect the main mill 5 to the whipstock tang 10. The mill is then pulled away from the whipstock in order to rupture the hose 21 or break the end connection between the hose 21 and the nipple 22. Preferably, breakage of the hose 21 is either at or adjacent to the nipple 22 or is located above the point where the hose 21 enters the passage 23. Rupture of the hose 21 allows the hydraulic fluid remaining in the chamber 19 to be dumped to the annulus, with the result that the piston 17 will move rapidly downwardly under the influence of string pressure in the chamber 18. The piston 17 will then strike the flow diverter 26 and break the shear ring 27, allowing the flow diverter 26 and piston 17 to assume the positions illustrated in FIG. 5. In these positions, the piston 17 has moved out of the cylinder 16 to establish a flow passage around the piston 17 as indicated by the arrows A. Ports 28 provided in the piston 17 allow flow from the exterior of the piston to the interior thereof and thence to the chamber 20 via the interior of the flow diverter 26. Aligned ports 29 and 30 in flow diverter 26 and mounting sleeve 31 permit flow from the chamber 20 to the circulation ports 25. Accordingly, with the components in the configuration illustrated in FIG. 5, fluid from the string can flow outwardly through the circulation ports 25 to cool and lubricate the blades 13,14 and displace debris from the blades for circulation up the annulus to the well head.

Once the bolts 8,9 have been sheared and the circulation ports 25 open as described above, the milling tool can be rotated and lowered to commence formation of the casing window. To this end, the whipstock 6 has, immediately below the tang 10, a ramp surface 32 which extends at a relatively large angle, for example 5°, to the longitudinal axis of the wellbore. The ramp surface 32 is hardened or is faced with hard material or is provided with wear resistant inserts, for example of tungsten carbide or diamond in order to prevent excessive wear of the ramp surface 32 as a result of contact of the side blades 14 of the main mill therewith. The side blades 13,14 of the main mill are likewise hardened or of hard and wear resistant material, for example tungsten carbide, so that they will not be excessively worn as a result of rubbing contact with the ramp surface 32. As the milling tool is lowered, the effect of the ramp surface 32 is to displace the main mill 5 laterally of the wellbore, thereby bringing the outer edge of the end blades 13 and the side blades 14 into engagement with the well casing. The well casing, being relatively soft as compared with the material of the blades 13,14, will be milled away by the action of the blades. Although some of the initial milling will be effected by the end blades 13, the majority of the initial milling is effected by the side blades 14 as the main mill is pushed sideways by the ramp 32.

The main deflecting surface 33 of the whipstock meets the ramp surface 32 at a point 34 which substantially corresponds to the main mill breaking through the casing, i.e., the point 34 can be radially spaced from an inner facing surface of the wellbore casing by a distance less than a diameter of the milling tool. The point 34 can preferably be spaced from an outer surface of the wellbore casing by a distance substantially equal to the diameter of the milling tool, thereby substantially corresponding to the milling tool cutting entirely through the wellbore casing when used. The main deflecting surface 33 extends at a relatively shallow angle, for example 2.8°, relative to the axis of the wellbore. Continued downward movement of the milling tool effects opening of the required window. During this phase of operation (i.e. after breakthrough of the casing window and until the window is complete) the majority of milling is effected by the end blades 13, the side blades 14 being used to clean the sides of the window which has been opened by the end blades 13 and to maintain gage diameter. It will be noted that the end blades 13 which are required to effect the majority of the milling during window formation are not subject, at any stage, to rubbing contact with the surface of the whipstock and accordingly maintain maximum sharpness to effect the required end milling. The side blades 14, having created the initial breakthrough of the window, are required to perform relatively little cutting operation during the remainder of the window forming operation and accordingly, if these blades are dulled as a result of the rubbing contact with the whipstock, this is not critical to the operation of the tool.

As mentioned above, the gage of the main mill 5 is somewhat less than that of the casing of the main wellbore. If it is desired to have the maximum possible diameter to the lateral, the watermelon mill is selected to be of the maximum size which can be accommodated by the main wellbore, with the result that the window and lateral bore will be opened up by the watermelon mill as the watermelon mill passes through the portions of the passage previously milled by the main mill 5.

Figure 2:
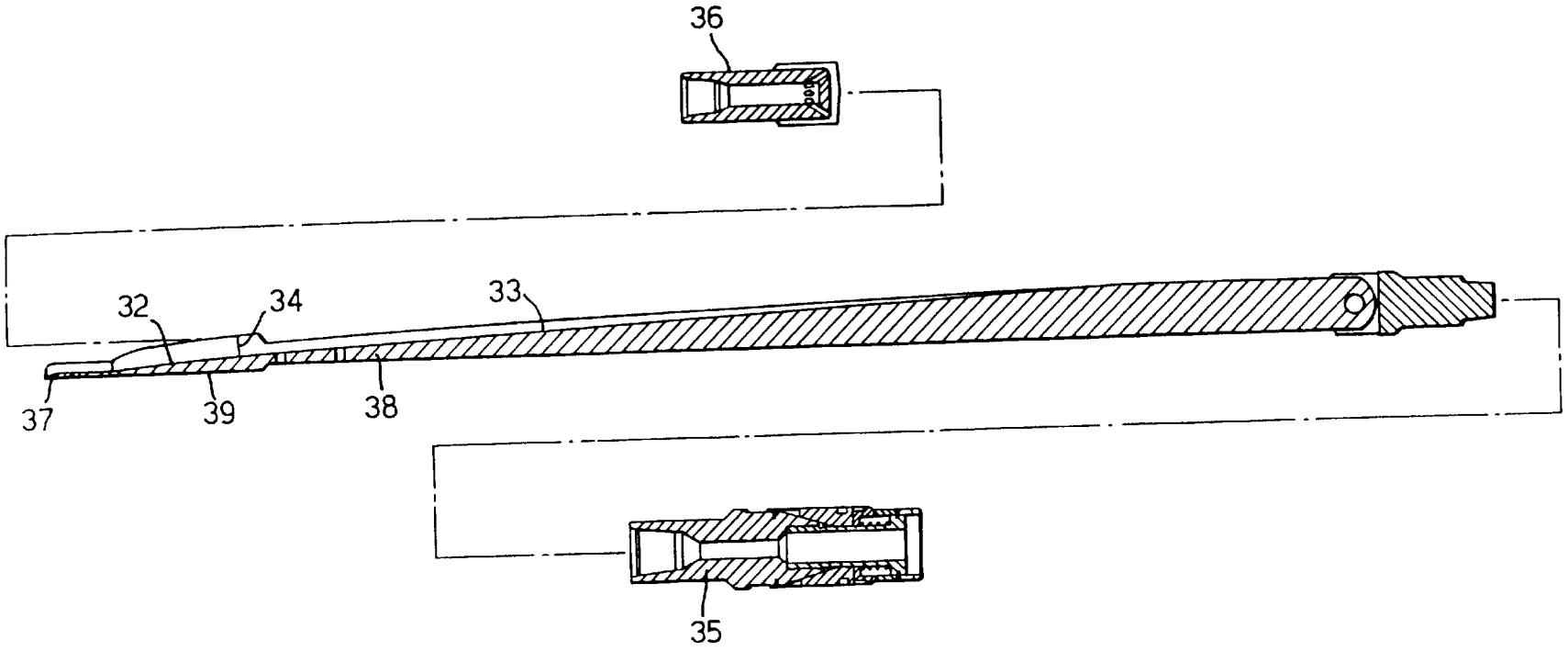
FIG. 2 illustrates a second embodiment of the invention.

Referring now to FIG. 2, an alternative embodiment of the invention which may in certain instances be of utility is illustrated. In this embodiment the hydraulic packer 7 of the previous embodiment is replaced by a bottom trip anchor which does not require hydraulic setting. Accordingly, the setting tool and hydraulic connections described above with reference to FIG. 1 are not required for the arrangement of FIG. 2. The main mill 36 of the FIG. 2 arrangement is secured to a tang 37 provided on the whipstock 38 in the same manner as the main mill 5 is secured to the tang 10 of the whipstock of the FIG. 1 embodiment, as more particularly shown in FIG. 3. The whipstock 38 exhibits the same ramp surface 32, main diverting surface 33, and transition point 34 as the whipstock 6 of FIG. 1 and accordingly once the bottom trip anchor 35 has been set and the shear bolts coupling the mill 36 and the tang 37 have been broken, the milling will be effected as described above with reference to FIG. 1. It will of course be appreciated that one or more additional mills, for example a watermelon mill as described above with reference to FIG. 1, will normally be attached to the assembly of FIG. 2 above the mill 36. For example, a watermelon mill as illustrated in FIG. 1, together with a flex joint as illustrated in FIG. 1 can be connected above the mill 36 by means of suitable connectors.

In the case of both the FIG. 1 and FIG. 2 embodiments, it will be appreciated by those skilled in the art that after opening up of the required window in the casing, and the initial drilling of the lateral, the continued drilling of the lateral can be effected using the main mill 5 or 36 if the required size of lateral and formation admit to the use of such a tool. In the alternative, the milling tool can be removed from the wellbore and an appropriate drillstring used to continue drilling of the lateral.

In general, it will be desirable for the whipstock to be removable after the lateral has been formed, and to this end the upper end of the whipstock is preferably formed with threads on the back surface 39 thereof so that a recovery tool having a female thread formed in the leading end thereof may be lowered over the upper end of the whipstock to engage the screw threads and enable the whipstock to be recovered. If recovery of the whipstock is required means will be provided for enabling detachment of the whipstock from its associated packer or anchor or, in the alternative, the packer or anchor design will admit to retrieval using conventional retrieval techniques.

What is claimed is:

1. A single trip whipstock assembly for forming a window in the casing of a wellbore, said casing defining an inner facing surface which defines the interior dimensions thereof and an outer facing surface defining the exterior dimensions thereof, the whipstock assembly comprising:

a whipstock having a milling tool attached to the upper end thereof and a packer or anchor attached to the lower end thereof, the milling tool having a diameter and the packer or anchor being settable to fix the depth of the whipstock prior to, but during the same trip as, operation of the milling tool to form the window in the casing of the wellbore, the upper end of the whipstock being formed with a ramp surface which extends at an angle to An axis of the wellbore greater than the angle of a main deflecting surface of the whipstock to the axis of the wellbore, wherein, when in use, the ramp surface meets the main deflecting surface at a point radially spaced from the inner facing surface of the wellbore casing by a distance less than the diameter of the milling tool.

2. A single trip whipstock assembly according to claim 1 wherein said point is radially spaced from the outer facing surface of the wellbore casing by a distance substantially equal to the diameter of the milling tool, such that said point substantially corresponds to the milling tool cutting entirely through the wellbore casing when in use.

3. A single trip whipstock assembly according to claim 1 wherein the ramp surface is hardened, hard faced, or provided with wear resistant inserts.

4. A single trip whipstock assembly according to claim 1 wherein the connection between the whipstock and the packer or anchor prevents relative rotation therebetween so that, after the assembly has been run into the wellbore to the required depth, the assembly can be orientated prior to setting of the packer or anchor and the connection between the whipstock and the packer or anchor will thereafter maintain the whipstock in the required orientation.

5. A single trip whipstock assembly according to claim 1 wherein the milling tool is secured directly to the top end of the whipstock by releasable fastening means.

6. A single trip whipstock assembly according to claim 1 wherein the milling tool includes a main mill having end blades on the end face thereof and side blades on the radial periphery thereof.

7. A single trip whipstock assembly according to claim 1 wherein the assembly includes at least one additional mill located uphole relative to the main mill.

8. A single trip whipstock assembly according to claim 1 wherein the packer or anchor is a hydraulic packer and the means for setting the packer comprises a hydraulic pressure generator located uphole of the whipstock and a severable connection between the hydraulic pressure generator and the hydraulic packer.

9. A single trio whipstock assembly according to claim 8 wherein the hydraulic pressure generator comprises a cylinder filled with hydraulic fluid and in communication with the severable connection, and a piston which can be acted upon by mud pressure supplied through a drillstring upon which the whipstock assembly is mounted in order to pressurize the hydraulic fluid.

10. A single trip whipstock assembly according to claim 9 wherein the hydraulic pressure generator is connected to the severable connection via a chamber located in the interior of the milling tool.

11. A single trip whipstock assembly according to claim 10 wherein the main mill includes circulation ports which, during milling, enable mud from the chamber of the milling tool to be circulated to the exterior of the milling tool and wherein the milling tool is provided with a diverter which initially isolates the circulation ports from the chamber so as to allow hydraulic pressure generated by the hydraulic pressure generator to be communicated to the severable connection.

12. A single trip whipstock assembly according to claim 11 wherein the piston of the hydraulic pressure generator is movable to a by-pass position which allows mud to flow past the piston and into the chamber of the milling tool after setting of the hydraulic packer has been completed and movement of the piston of the hydraulic pressure generator into its by-pass position simultaneously opens the circulation ports of the milling tool to the chamber thereof.

13. A single trip whipstock assembly according to claim 1 wherein the packer or anchor is a bottom trip anchor.

14. A single trip whipstock assembly according to claim 5, wherein said releasable fastening means comprise shear bolts.

15. A single trip whipstock assembly according to claim 7, wherein said at least one additional mill is a watermelon mill.

* * * * *

UNITED STATES PATENT AND TRADEMARK OFFICE

CERTIFICATE OF CORRECTION

PATENT NO. : 6,050,334

DATED : April 18, 2000

INVENTOR(S) : Bruce McGARIAN et al.

It is certified that error appears in the above-identified patent and that said Letters Patent are hereby corrected as shown below:

Insert in the title page:

[73] Assignee: Smith International, Inc.
Houston, Texas

Signed and Sealed this

Twenty-second Day of May, 2001

*Attest:*

Nicholas P. Godici

NICHOLAS P. GODICI

*Attesting Officer*

*Acting Director of the United States Patent and Trademark Office*